United States Patent [19]

Wokas

[11] 4,166,485

[45] Sep. 4, 1979

[54] GASOLINE VAPOR EMISSION CONTROL

[76] Inventor: Albert L. Wokas, 22245 Thorofare, Grosse Ile, Mich. 48138

[21] Appl. No.: 704,197

[22] Filed: Jul. 12, 1976

Related U.S. Application Data

[63] Continuation of Ser. No. 351,767, Apr. 16, 1973, abandoned.

[51] Int. Cl.[2] ..... B65B 57/06; B67C 3/26

[52] U.S. Cl. ..... 141/52; 141/59; 141/207; 141/311 R; 141/392; 285/345

[58] Field of Search ..... 141/392, 311, DIG. 1, 141/192-229, 52, 59; 285/345; 277/88, 89, 90, DIG. 2

[56] References Cited

U.S. PATENT DOCUMENTS

| | | | |
|---|---|---|---|
| 3,566,928 | 3/1971 | Hansel | 141/392 |
| 3,590,890 | 7/1971 | Young | 141/198 |
| 3,603,359 | 9/1971 | Belue | 141/208 |
| 3,811,486 | 5/1974 | Wood | 141/208 |
| 3,881,528 | 5/1975 | Mackenzie | 141/52 |

*Primary Examiner*—Houston S. Bell
*Attorney, Agent, or Firm*—Harness, Dickey & Pierce

[57] ABSTRACT

A system of nozzles and seals provides a means to return gasoline vapors from a gasoline tank to a gasoline storage tank.

18 Claims, 21 Drawing Figures

GASOLINE VAPOR EMISSION CONTROL

RELATED APPLICATION

This application is a continuation of U.S. Pat. application Ser. No. 351,767, filed Apr. 16, 1973, entitled "Gasoline Vapor Emission Control", which is now abandoned.

BRIEF SUMMARY OF THE INVENTION

This invention relates to a vapor recovery nozzle system and spout that permit the recovery of petroleum vapors that escape from the fill pipe of an automobile gasoline tank when same is being filled with gasoline at a service station. The vapor recovery nozzle spout (or end) when complimented with a special vapor seal, permits the capturing of vapors at the interface of the hose nozzle and the automobile gasoline tank fill pipe and returning the vapors through a hose back to the product dispenser. The concept of a complete closed vapor recovery system at a retail service station is illustrated in FIG. 1. Gasoline is brought to the station in a tank truck 44. The truck makes a tight connection to the underground fill pipe 23 and discharges gasoline from the tank truck through the unloading hose 24 connected to the bottom of the truck into the underground storage tank 25. The underground tank vents through a vent pipe which is intercepted by a hose 26 that returns the vapor to the top of the tank truck 44. This is an equal volume displacement and exchange system for capturing and returning vapors to the bulk plant.

The gasoline in the underground tank 25 is made available to the customer by pumping same through the island dispenser 17 into the automobile gasoline tank. A vapor recovery nozzle (see FIG. 2) on the end of the product hose 22 permits capturing vapors at the automobile fill pipe 12 and returning them through the vapor return hose 7 to the dispenser 17 on the pump island and then to the underground tank 25.

DESCRIPTION OF THE INVENTION

This invention is made up of two types of vapor recovery nozzle spouts (see FIGS. 3 and 5) and several types of vapor seals (see FIGS. 6, 7, 10, 13, and 14). The principal design criterion is to provide a vapor recovery nozzle spout that resembles existing nozzles in appearance and function.

Figure 1:
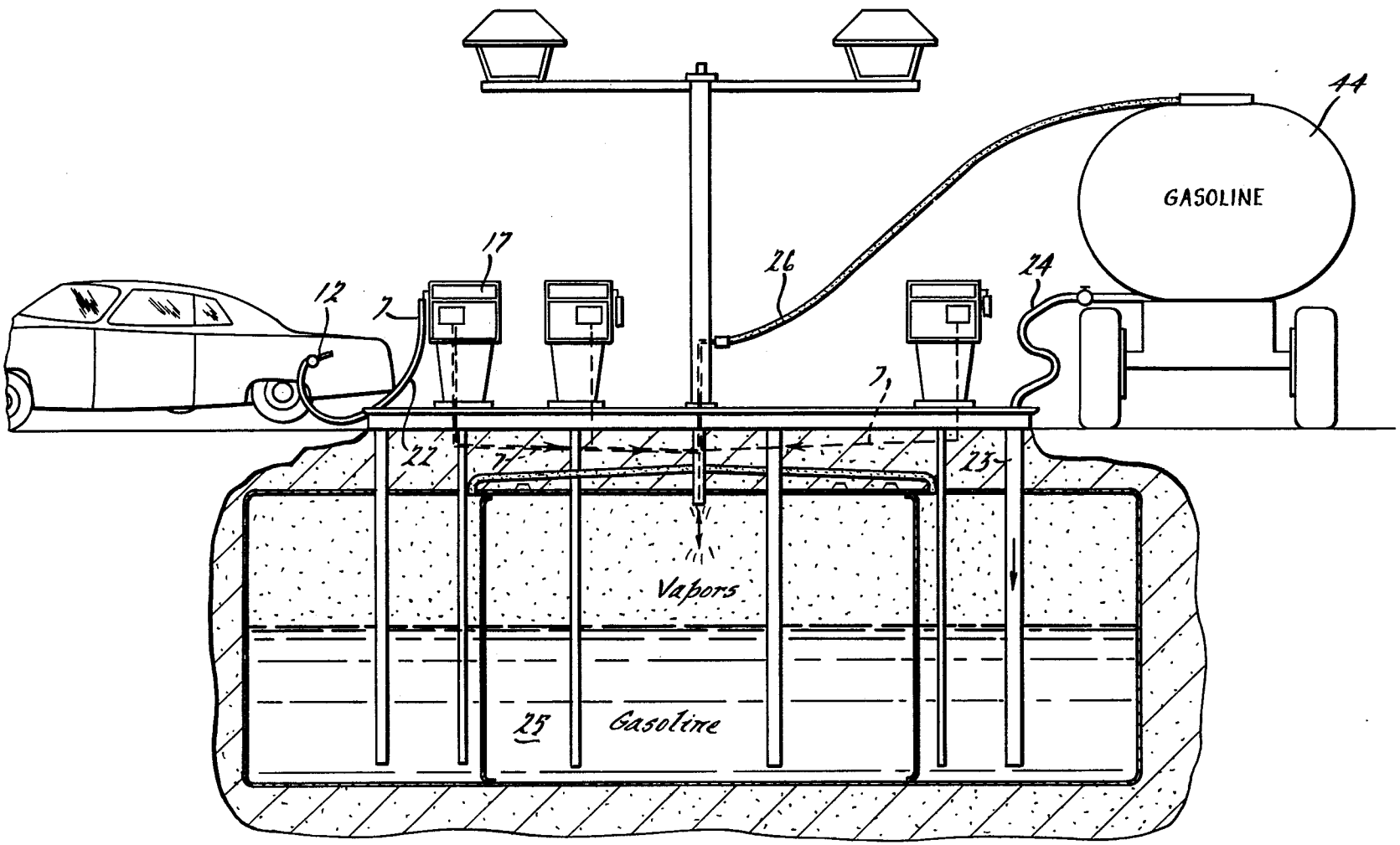
FIG. 1 is a frontal view of an automobile at a service station pump island being serviced from a gasoline dispenser 17 that has installed on the end of the pump dispenser product hose 22 a vapor recovery nozzle spout (see FIGS. 2 and 4) and a vapor seal (see FIGS. 6 and 7). Gasoline passes through the product hose 22 and nozzle into the fill pipe 12 of the automobile gasoline tank in the normal manner. The tight seal 18 (see FIGS. 6 and 7) at the opening of the automobile tank fill pipe 12 forces the vapors to pass through the vapor recovery portion of the nozzle (see FIGS. 2 and 4) and then back through the vapor recovery hose 7 that parallels the product hose 22 to the dispensing unit 17 on the pump island.
Figure 2:
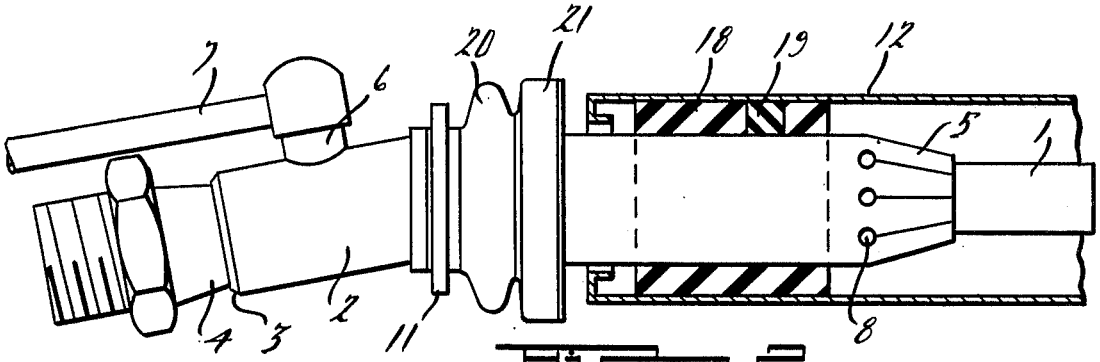
FIG. 2 is a view of a vapor recovery nozzle spout showing elements of the invention including the vapor return hose 7, a tight vapor seal bushing 18 permanently placed and secured in the automobile gasoline tank fill pipe 12 and an axially expandable sleeve 20 with magnetic ring seal 21 attached to the nozzle and positioned to make contact with the end of the carbon steel fill pipe 12.
Figure 3:
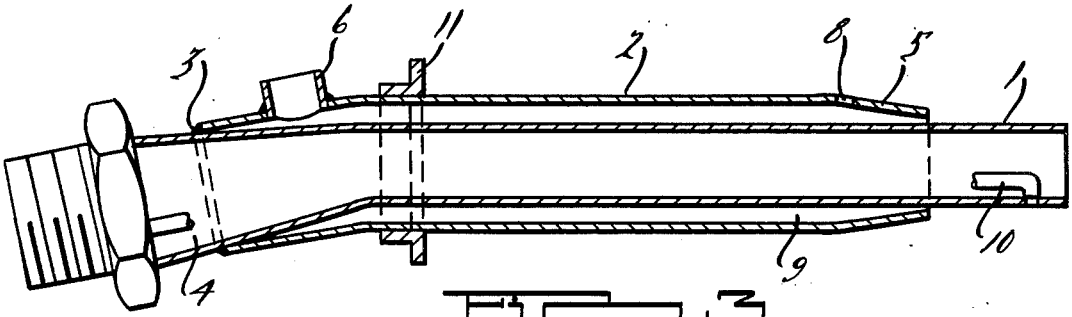
FIG. 3 is a longitudinal cross sectional view of the basic vapor recovery nozzle spout of FIG. 2 without vapor seals or vapor return hose. The vapor recovery cylinder 2 is tapered at the end 5 to permit easy insertion through the permanently installed tight seal (see FIG. 6) located in the gasoline tank fill pipe 12.

The vapor recover nozzle spout shown in FIG. 3 is made up by slipping over a standard type product nozzle spout 1 a metal cylindrical vapor recovery tube 2 and sealing tight one end 3 to the neck 4 of the standard product nozzle spout 1. The opposite end 5 of the vapor recovery cylinder 2 is tapered to permit easy access to and through the tight seals (see FIGS. 2, 4, 6, 13, and 14). A nipple 6 is welded to the vapor recovery cylinder 2 to provide a means of attaching the vapor recovery hose 7 (see FIGS. 1, 2, and 11) that leads back to the gasoline pump or dispenser 17. The tapered end 5 of the vapor recovery cylinder 2 fits loosely over the standard product nozzle 1 and has slotted openings 8 to provide inlet passage for the vapors. The effective cross sectional area between the two cylinders 9 is preferably approximately one third the cross sectional area of the product nozzle 1. The vapor recovery nozzle spout will not interfere with the operation of the automatic nozzle tube component 10 normally located near the end of the product nozzle spout 1. A permanent stop 11 is secured to the nozzle spouts 2 and 13 to protect nipple 6 and control depth of nozzle spout penetration into fill pipe 12.

Figure 4:
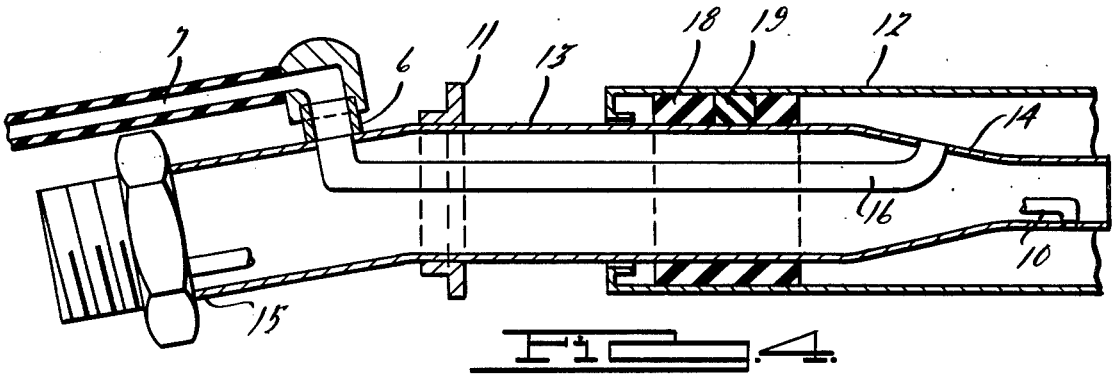
FIG. 4 is a cross sectional view of a modified vapor recovery nozzle spout showing the invention including the vapor return hose 7, and a tight vapor seal bushing 18 permanently placed in the automobile gasoline tank fill pipe 12. The expandable sleeve 20 with magnetic ring seal 21 (see FIGS. 2 and 7) is not shown in the view but can be installed if desired.
Figure 5:
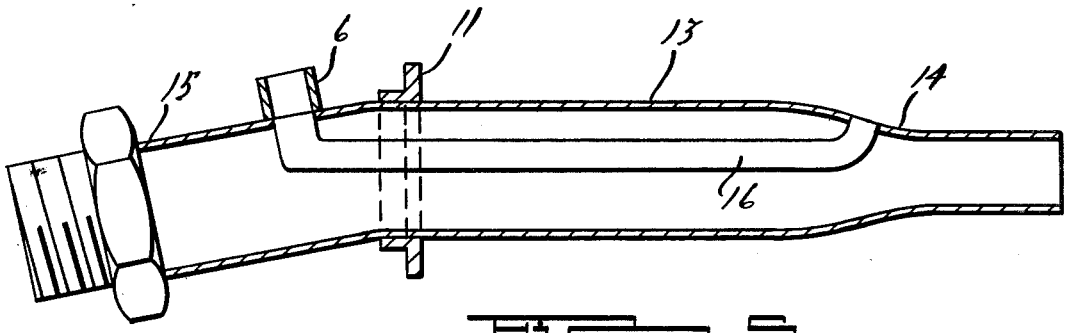
FIG. 5 is a cross sectional view of the vapor recovery nozzle spout of FIG. 4 without vapor seals or vapor return hose, (see FIG. 4). The spout 13 is tapered at one end 14 to permit easy passage through the vapor tight seal 18.

The vapor recovery nozzle spout shown in FIGS. 4 and 5 is made from a cylindrical tube 13 that is tapered at one end 14 and secured to a threaded or pressure connection at the other end 15. The tube may be curved if desired. Two openings are made in the walls of the cylindrical tube nozzle spout 13 to which is attached and welded tightly in place a vapor return tube 16. A nipple 16 is welded to the vapor return tube to provide a means of attaching the vapor recovery hose 7 (see FIGS. 1, 4, and 5) that leads back to the dispenser 17.

Figure 6:
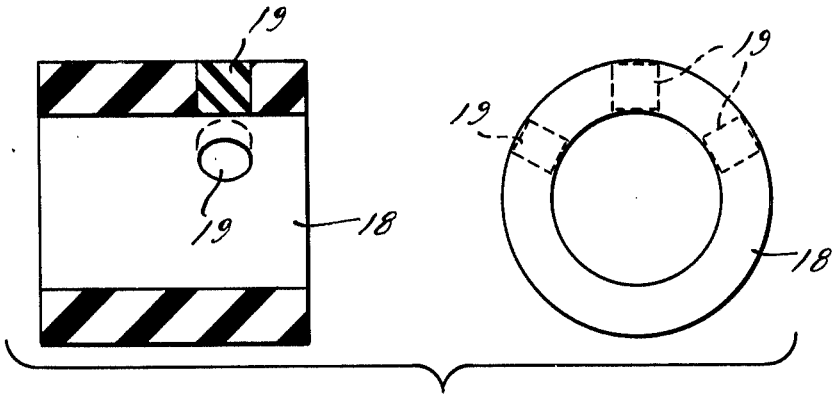
FIG. 6 shows a cross sectional view and an end view of a special tight vapor seal 18 that can be permanently installed in the automobile gasoline fill pipe 12.
Figure 14:
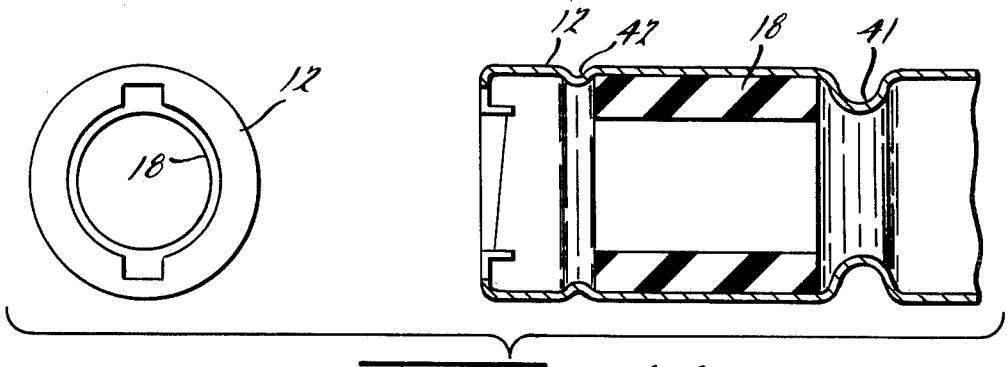
FIG. 14 is a cross section and end view of a fill pipe and seal for no-lead engines.

The vapor seals shown in FIGS. 6 and 14 are permanently installed in the fill pipes 12 of the automobile gasoline tanks and permit the vapor recovery nozzle spouts (see FIGS. 2 and 4) to pass through same providing a friction fit and a tight vapor seal. The tight seal bushing 18 is made of a tough flexible material that may be of appropriate lengths and diameters to fit different types of automobile fill pipes 12. The inside diameter of all bushings 18 will be one government specified standard size for leaded gasolines and another (smaller) standard size for unleaded gasolines. The outside diameter of the vapor recovery nozzle spout (see FIGS. 2 and 4) is slightly larger than the inside diameter of the bushing 18 thus producing a friction fit and a vapor seal when the nozzle spout is inserted in the bushing. High density cylindrical wearing plugs 19 (FIG. 6) can be inserted in the tight seal bushings 18 to provide additional stability and direction to the nozzle spout (FIGS. 2 and 4) as it is placed in the fill pipe 12 for filling. The plugs are preferably at least the top half of the bushing and serve to hold the nozzle in substantial axis alignment with the bore of the bushing even though the operator releases the nozzle and the full weight and moment arm is taken by the bushing. This prevents leakage due to canting during unattended filling of the tank. For all newly built automobiles, the gasoline tank fill pipes 12 can be built with standard size openings and standard size tight seal bushings 18 (see FIG. 14).

The vapor seal (see FIG. 6) bushing is preferably made up of two grades of gasoline resistant materials as illustrated by the following example. The cylindrical body 18 is composed of a dense, spongy Buna-N Stock SPNIG-R416 -14 ASTM SBE42. Its characteristics include the compressibility needed for a tight fit when the nozzle spout is inserted; the resilience to spring back to its original form when pressure is released. This combination of compressibility and resilience along with toughness and durability mades for good friction fit and vapor seal.

Inserted into the culindrical bushing 18 in a single circumferential ring are several hard wearing plugs 19 made from Buna-N 375 cord stock. This arrangement aids in guiding the nozzle spout through the bushing and in holding the spout in a secure position centered in the fill pipe enabling the spongy cylindrical vapor seal 18 to hold and seal the nozzle spout in place while dispensing gasoline. For installation purposes, the vapor seal bushing 18 is flexible enough to be reduced in size to enable same to pass through the fill pipe openings. Once inside it springs back to its original round shape and becomes permanently placed against side walls of fill pipe with pre-applied adhesive such as epoxy glue.

Figure 7:
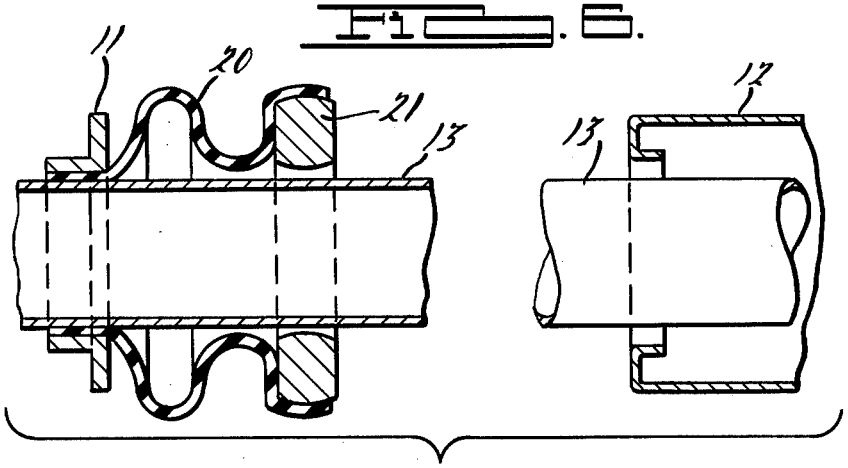
FIG. 7 is a cross sectional view of the expandable sleeve 20 and the magnetic ring 21 that can be attached to the vapor recovery nozzle spout 2 and 13 to provide a vapor seal at the face of the gasoline tank fill pipe 12.

The vapor seal shown in FIG. 7 is attached to the vapor return nozzle spouts (see FIGS. 2 and 4) at the stop ring 11. An expandable sleeve 20 is attached to the vapor return nozzle spout at one end forming a tight seal. The other end is attached to a doughnut shaped magnetic ring 21 which can move freely along the nozzle spout until it magnetically engages and seats on the face of the automobile gasoline fill pipe 12 when the nozzle is inserted in same, thus creating a vapor seal at the contact area.

Figure 8:
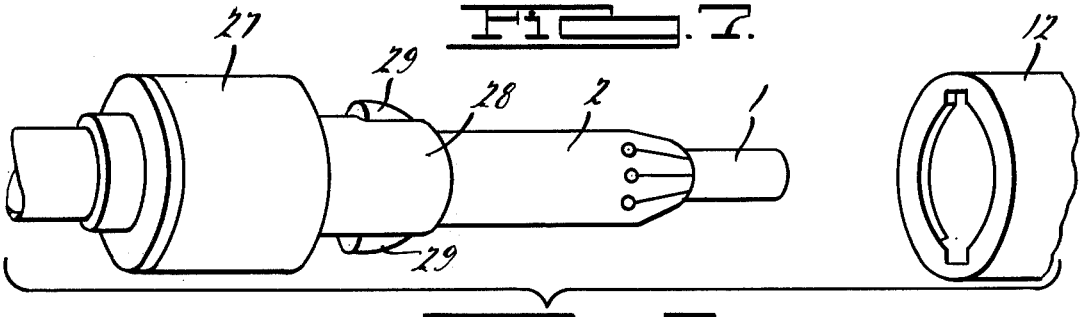
FIG. 8 is an exploded perspective view of a modified form of nozzle.
Figure 9:
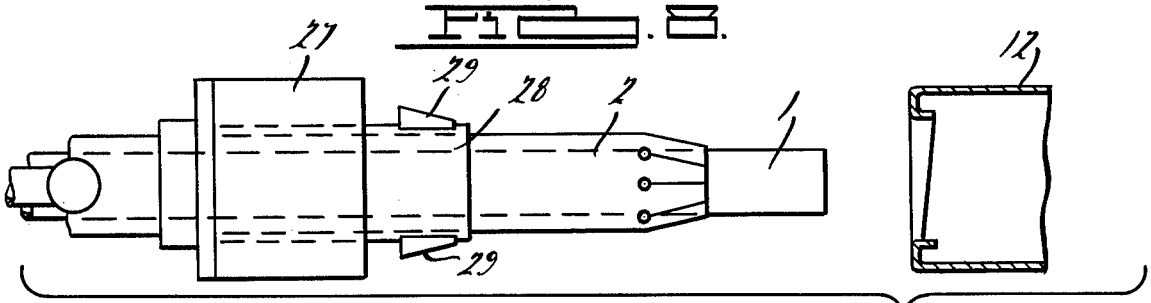
FIG. 9 is a side elevation and section of the nozzle of FIG. 8.

FIGS. 8 and 9 show a vapor recovery nozzle spout 2 with a vapor seal adapter (see FIG. 10) mounted on same which may be used during the interim period before all automobiles and trucks have permanent seals installed at the factory.

Figure 10:
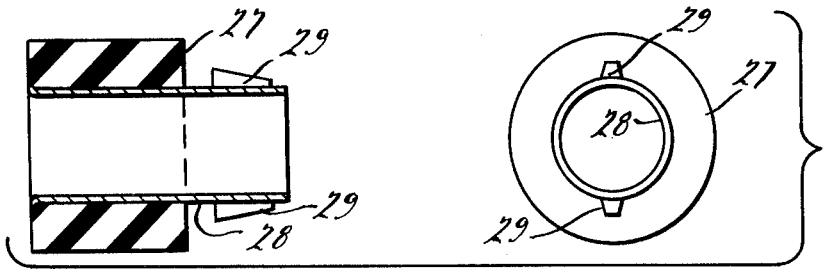
FIG. 10 is a longitudinal cross section and end view of the adapter of FIGS. 8 and 9.

FIG. 10 illustrates the adapter which is made up of a flexible Buna-N cylindrical bushing 27 similar in design and shape to the vapor seal bushing 18 (see FIG. 6). The bushing 27 is mounted on a metal tube 28 and secured to it with suitable adhesive such as epoxy glue. The inside diameter of the metal tube 28 is slightly larger than the outside diameter of the nozzle spout 2 to permit easy fit. Two projections or "lugs" 29 are welded to the metal tube to provide a means of holding the unit in place when positioned in the fill pipe. The action of the two "lugs" 29 is the same as the two lugs on the gas cap that fits in the fill pipe openings. The two lugs 29 are designed to pass through the two notches on the gasoline fill pipe opening 12, and will hold the seal bushing 27 tight against the face of the fill pipe when the nozzle is placed in the filling position. By forcing the nozzle hard into the fill pipe and twisting to lock in place a tight seal is created by the compressed bushing bearing on the stop ring 11 and the face of the fill pipe 12. This system (FIG. 8) can be used with or without the vapor tight seal 18 (see FIG. 6) that is permanently installed in the fill pipe. The seal 18 will keep the nozzle spout 2 centered in the fill pipe and hold it from tilting or entering at an undesirable angle thus resulting in a more positive 360° contact of the spongy bushing seal 27 and the face of the fill pipe 12. Secondly, the friction fit of the tight fit seal 18 will tend to hold the nozzle in a set position thus improving the ability of the spongy bushing seal 27 to remain in contact with the face of the fill pipe 12.

Figure 13:
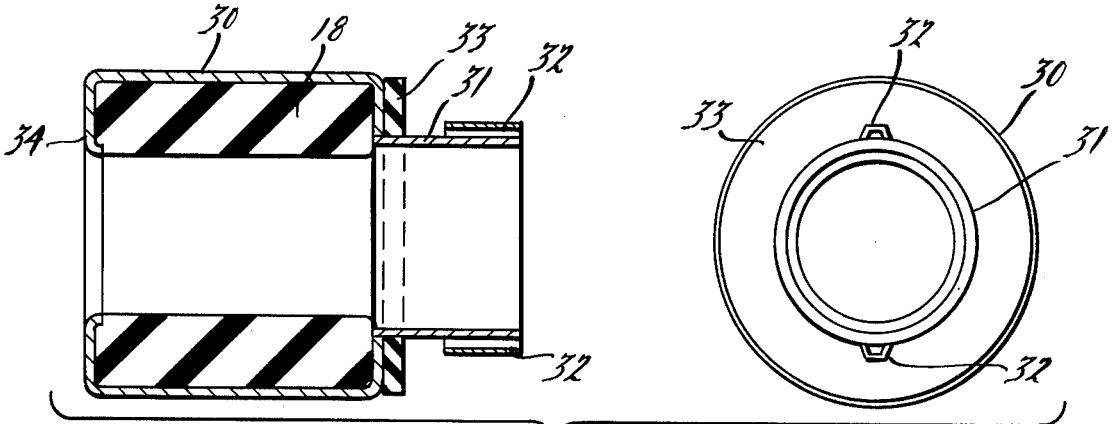
FIG. 13 is a cross section and end view of an adapter for the end of the fill pipe.

FIG. 13 is a view of a retro-fit adapter that can be mounted on the face of the fill pipes 12 of existing automobiles and is secured to same, using the gas cap-cam connections on the fill pipe 12. The retro-fit adapter contains the seal 18 permanently installed in the adapter. The adapter when mounted on the face of the fill pipe, becomes an extension of the fill pipe thus eliminating the need to install anything inside of the gas tank fill pipe. The retro-fit adapter is made up of a cylinder 30 of similar diameter of the fill pipe (approximately 2"), a ring adapter 31 with "lugs" 32 that fits into the two notches in the gasoline fill pipe (FIG. 8), a ring gasket 33 that fits between the adapter and the fill pipe and against the fill pipe and face, and the tight seal bushing 18 (see FIG. 6). To make the adapter work properly, the unit is built to accept the vapor recovery nozzle spouts (see FIGS. 3 and 5). The metal cylinder 30 is made of tubing similar to the gasoline fill pipe and is shaped and sized as shown to guide and support the vapor recovery nozzle spout at two points (i.e., the turned in opposite ends) thus eliminating tilting and sloppy nozzle fit at the bushing 18. The returns at each end 34 of the cylinder are designed to have a resulting diameter opening that is slightly larger than the outside diameters of the vapor recovery nozzle spouts 2, 13. On one end of the face of the cylinder is permanently secured a ring adapter 31 with lug 32 projections that fit into the notches in the fill pipe and turn to made a solid mechanical connection. The vapor recovery nozzle spout is then positioned through the retro-fit adapter and is ready to function in the same manner as described for the vapor seal that is installed in the fill pipe (FIG. 2).

The two types of vapor recovery nozzle spouts shown in FIGS. 3 and 5 will be made of a non sparking metal, usually brass or aluminum. The nipple 6 that is welded to the vapor return system can be located on the circumference of the nozzle spout based on the most convenient spot for securing the vapor return hose 7 and returning same along the nozzle body to create the least interference with the operation and handling of the total nozzle and hose system. For clarity of illustration, FIGS. 2 and 4 show a top mounting for the nipple and vapor hose return. In practice however, a side mounting permits a more convenient path for the vapor return hose 7 to pass the main body of the nozzle.

Figure 11:
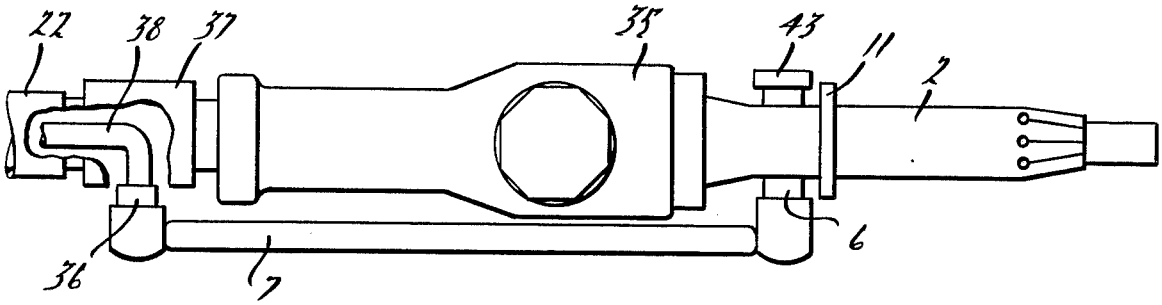
FIG. 11 is a plan view of a modified nozzle.
Figure 12:
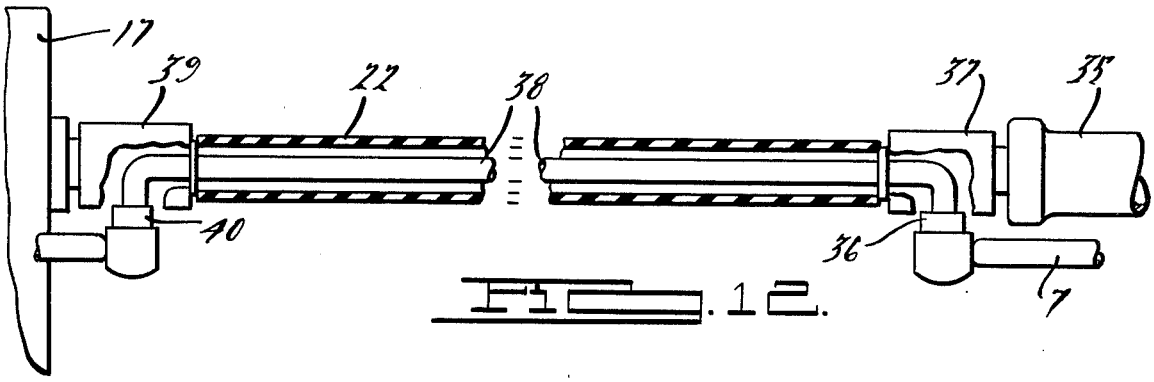
FIG. 12 is a cross sectional view, broken away, of the vapor return conduit connecting the nozzle 35 and gasoline pump 17.

FIG. 11 shows a top view of the vapor recovery nozzle spout 2 and main body of the nozzle 35 which contains the valve mechanism that controls the on and off of the product (gasoline) flow. Also shown is the vapor return hose 7 attached to the nozzle spout 2 and passing across the body of the nozzle 35 back to the product hose 22. In its simplest form the vapor return hose 7 runs parallel to the product hose 22 and is secured to the outside of same with clamps or wrappings. At the dispenser the vapor recovery hose 7 is eventually diverted to a pipe that leads to the underground tank 25. In the path between the dispenser 17 on the pump island and the underground tank 25 the vapors may be subjected to one of several treatments. It could be pumped, cooled or refrigerated, compressed and recycled, passed through charcoal filters before or after passing through the underground tank systems or even ignited and burned. The combination of events that will meet the requirements and standards of minimum pollution and proves to be the most economical and practical in operation will be the system adopted to solve the problem. Having successfully captured the vapors at the interface of the hose nozzle and gasoline tank fill pipe, an additional improvement in handling the vapors through the return hose system is shown in FIGS. 11 and 12.

FIG. 11 illustrates a short jumper hose 7 that connects on one end to the nipple 6 on the vapor recovery nozzle spout and on the other end to a nipple 36 on the hose adapter 37 that is screwed into the main body of the nozzle 35 through which the product flows. The nipple 36 on the hose adapter 37 fitting is attached to an internal hose 38 that is placed inside the product hose 22 and becomes the vapor return hose that leads from the nozzle to the dispenser 17, (see FIG. 12). At the dispenser another hose adapter 39 and nipple 40 is installed to permit connecting to the vapor return hose and directing the vapors to its next path of final disposition.

The justification for containing this portion of the vapor recovery hose 38 inside of the product hose 22 is two-fold. First, product hoses now being used are tough and would give great protection to the vapor return hose 38 placed inside same. External appearances and the handling of the dispensing hose would remain the same as presently practiced with very little chance of damage and malfunction of the vapor recovery hose 38. Secondly, in warm climates the cool gasoline being pumped into a warm automobile gasoline tank would cause an instant surplus of vapors through the return vapor hose that is located inside the product hose and surrounded by cool product the warm expanded vapors will tend to cool and reduce in volume to more nearly equal the volume of product being pumped out of the underground tank. Additional cooling of the returning vapors can be accomplished by containing the return vapor recovery line inside the product line that is located between the dispensing island and the underground storage tank. An in-line condenser or cooler may also be installed prior to shunting the vapors into the underground tank.

Two systems are to be designed for handling vapor recovery at the nozzle. One system is for retro-fit, that is handling all automobiles built prior to the use of non-leaded gasoline. These existing automobiles use leaded gasoline and the federal government nozzle spout specifications will fit only the lead burning engines. The second system is for the non-lead burning engines and the government nozzle specification differs so the two may not be interchanged. Once a vapor recovery nozzle spout and tight seal is designed and accepted for the no-lead automobile, it will be universal in design and fit and function on all no-lead using automobiles. Because of the great variety of fill pipe designs now included on existing automobiles, a variety of problems occur when designing a vapor recovery nozzle. These can be overcome if all automobiles installed in their fill pipes a tight vapor seal (see FIG. 6) and used the vapor recovery nozzle spout (see FIGS. 3 and 5) as described.

Figure 20:
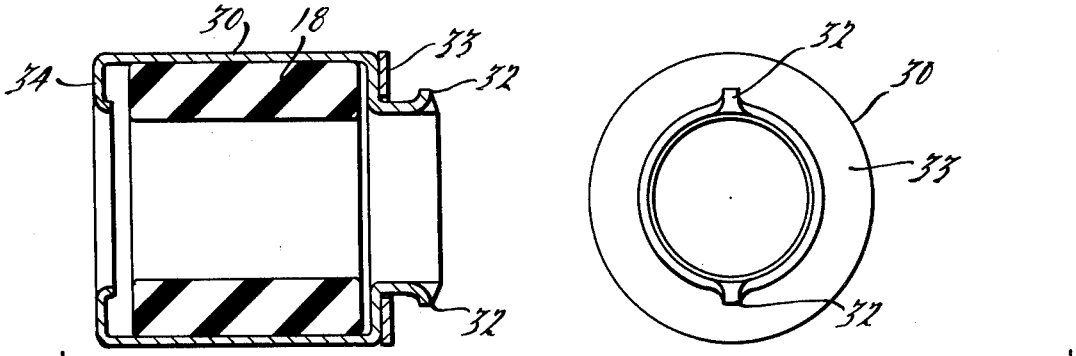
FIG. 20 is a cross sectional view of an adapter that becomes an extension to the automobile gasoline fill pipe when attached to same.
Figure 21:
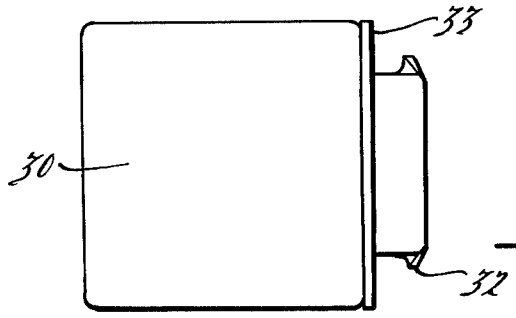
FIG. 21 is a side view of the gasoline fill pipe adapter extension that is shown in FIG. 20

During the interim period before seal bushing 18 is installed in the fill pipes of all vehicles, an adapter type of vapor seal may be used to provide instant conversion to vapor emission control. (FIGS. 8 and 13). FIGS. 8 and 10 show an adapter seal system that is installed on the vapor recovery nozzle and secured to same with an adhesive between the stop ring 11 and the Buna-N bushing 27. The connection between the stop ring and bushing may also be made with a tight fitting rubber sleeve. FIG. 13 shows an adapter that is designed to be mounted on the face of the automobile gasoline fill pipe and becomes an extension of same. It is removed each time the filling operation is completed and used on the next car to be serviced. Once this adapter is secured to the fill pipe the vapor recovery nozzle spouts (see FIGS. 3 and 5) are inserted through the tight fit vapor seal 18 and operated as previously described for the permanently installed tight fit vapor seals. FIGS. 20 and 21 show an adapter extension modified from FIG. 13 and made up of a cylindrical tube 30 that is shaped at the nozzle spout entrance (see FIGS. 3 and 5) end 34 to receive and support the spout and shaped at the other end with protruding lugs 32 pressed in the end of the tube for attaching to the fill pipe opening. A gasket 33 forms a tight seal between the adapter cylinder 30 and the face of the fill pipe 12 when the adapter is twisted in place. A vapor seal 18 is installed and glued inside the adapter cylinder 30 and performs the same function as when permanently installed inside the gasoline fill pipe.

FIG. 14 shows an automobile gasoline fill pipe designed for no-lead engines. This design can be used on all new U.S. automobiles beginning with 1975 models. Included in the original manufacturing will be the vapor seal 18 with an inside diameter sized to receive the smaller sized vapor recovery nozzle spout specified for no-lead gasoline dispensers. The no-lead fill pipe 12 (see FIG. 14) is designed with a government specified opening. A depression ring 41 is formed in the pipe 12 with the same inside diameter as the fill pipe opening dimension. This depression ring is located approximately 2½" in from the face of the fill pipe 12 and acts as a guide and support for the nozzle spout. A similar depression ring 42 can be located near the entrance of the fill pipe to position and hold the vapor seal which is also preferably secured in place with adhesive. If fill pipe on new no-lead using automobiles is not manufactured as illustrated, the standard tight fit vapor seal 18 as described for use on existing cars can be used on new cars.

On all systems using vapor tight connections, it is desirable to include a safety relief valve in case of a malfunction. A pressure build up could occur while pumping product if the venting system was shut off thus causing a possible rupture in the automobile gasoline tank or fueling system. Also, an excessive vacuum in the vapor return hose caused by a malfunctioning vacuum pump could damage or collapse the automobile fuel tank. To prevent this possibility, the vapor recovery system is provided with a safety relief diaphragm 43 or valve (see FIG. 11). The diaphragm will rupture or the valve will open if the pressure or vacuum exceeds the safe limits set by the car manufacturers.

Figure 15:
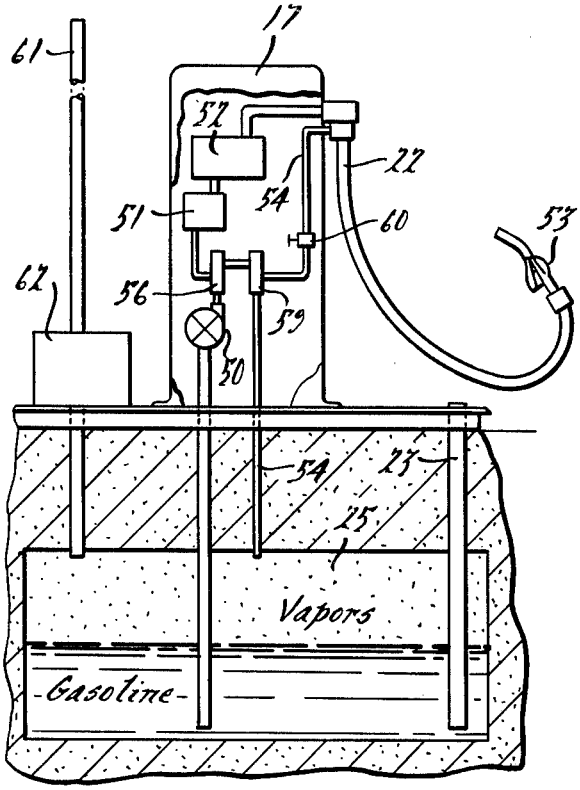
FIG. 15 illustrates a suction pump gasoline dispensing system.
Figure 16:
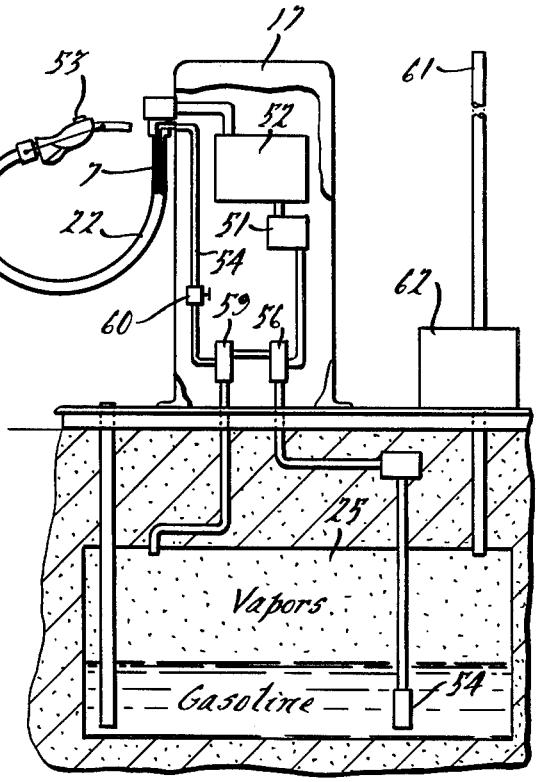
FIG. 16 illustrates a submersible pump dispensing system.

FIGS. 15 and 16 illustrate two types of gasoline dispensing systems used in the United States. FIG. 15 shows a system that uses a suction pump 50 installed in the gasoline dispenser 17 to pump gasoline from the underground tank 25 through the meter 51 and past the computer 52, through the product hose 22 to the pump nozzle 53. For fueling automobiles the pump nozzle spout (see FIGS. 3 and 5) is placed in the automobile gasoline fill pipe 12. FIG. 16 shows a system that uses a submersible pump 54 located in the bottom of the underground gasoline tank 25. The pump pushes the gasoline up to the gasoline dispenser 17 and through a system similar to that described in FIG. 15.

The vapor recovery nozzle spouts, the vapor seals, and the compression seals described in this invention work on the equal volume exchange, closed system principle of handling gasoline and vapors. In its simplest form, gasoline is pumped through the vapor recovery nozzle 53 past the seal 18 into the gasoline tank. The gasoline displaces the vapors and forces them, under pressure, back through the recovery nozzle into the vapor return hose 7 that leads back to the dispenser 17. At the dispenser the vapor return hose is connected to a vapor return pipe 54 that leads through the dispenser and discharges into the underground tank that may be located directly under the dispenser island 55 or more often at some remote location away from the island. This long vapor return line creates a pressure build up in the automobile gasoline tank that can cause problems. To overcome the pressure build up, a vacuum pump or exhauster can be installed in the vapor return line.

Figure 17:
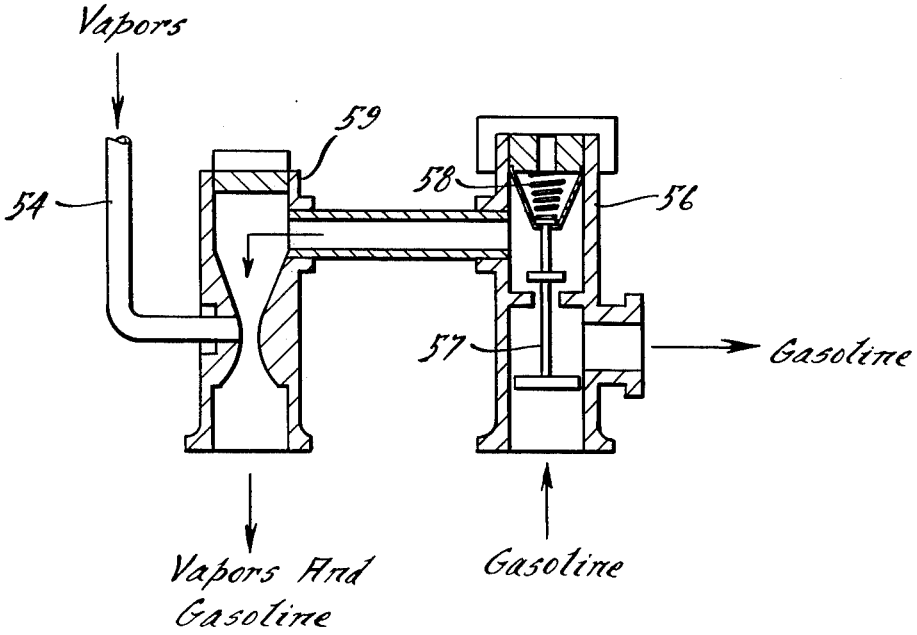
FIG. 17 is a cross section through a vacuum vapor exhaust system using gasoline flow to actuate vapor flow.

FIG. 17 is an illustration of a vacuum exhaust system that can be installed in the dispenser 17 housing and connected to the vapor return line. Its principle of operation is based on product flow and is controlled by the opening and closing of the nozzle valve. The exhaust vacuum only functions when the valve is opened and flow occurs. This prevents the underground tanks from becoming over charged with air when the pump is running but not discharging product.

The flow valve 56 consists of a double poppet 57 that works against a pre-set pressure spring 58 when the nozzle valve 53 is opened. A pressure drop on the discharge side of the flow valve permits the pump pressure and flow of product against the inlet side of the large poppet to move same against the spring and open the ports for product flow to the nozzle and also to the venturi exhauster 59. Product flowing through the venturi causes a vacuum in the vapor return line 54 aiding in moving the vapors from the automobile gasoline tank to the underground tank. When the pump nozzle 53 is shut off, the product pressure on each side of the large poppet equalizes permitting the pressure spring 58 to return the small poppet to the closed position, thus shutting off the vacuum exhaust venturi 59. The vapor return line is still opened to free movement of vapors. The large diameter poppet in the flow valve 56 is designed with small open ports to permit product flow for pressure equalization when the nozzle valve is closed. A vacuum diaphragm regulator valve 60 is installed in the vapor return to protect against excessive vacuum that could cause damage to the automobile fuel system.

The underground tank is vented 61 to the atmosphere to eliminate danger of excess pressure or vacuum in the entire system. Connected to the underground tank vent line is a carbon canister 62 to remove the hydrocarbons or other undesired emissions that are discharged in the vapors through the vents.

Figure 18:
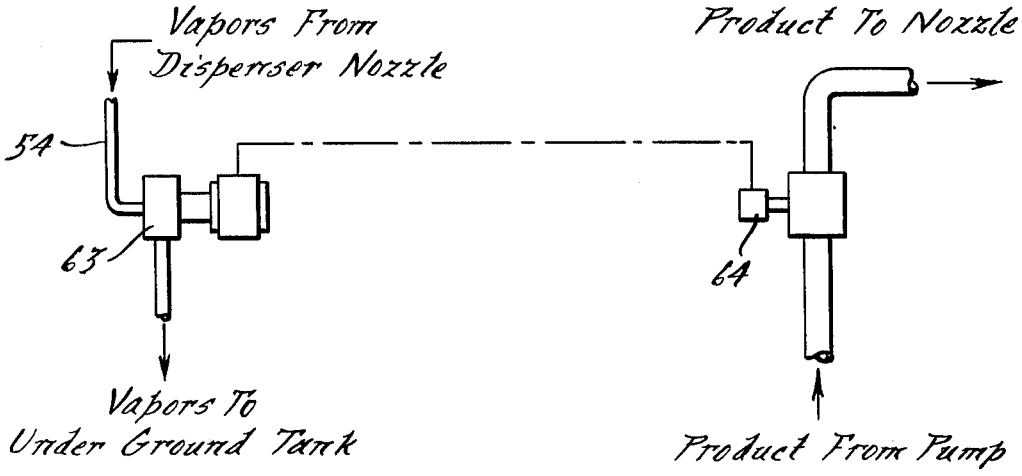
FIG. 18 is a schematic view of a vapor exhaust system using a pump.

FIG. 18 shows a motor operated vacuum pump and electric pressure switch. The motor operated vacuum pump 63 is controlled by a pressure differential in the product flow line. This permits activating the vacuum pump for exhausting vapors only when the dispenser nozzle is in the "on" position dispensing fuel. When the dispenser product pump 50 and 54 is activated, the system is under equal pressure from pump discharge to nozzle valve. Nozzle shut off pressure keeps the electrical pressure switch in the "off" position. When the dispenser nozzle is opened and product begins to flow, the pressure on the discharge side of the pump decreases and activates the pressure switch 64 which then activates the motor operated vacuum pump 63 thus exhausting the vapors from the automobile gasoline tank through the vapor return hose into the underground tank 25.

Figure 19:
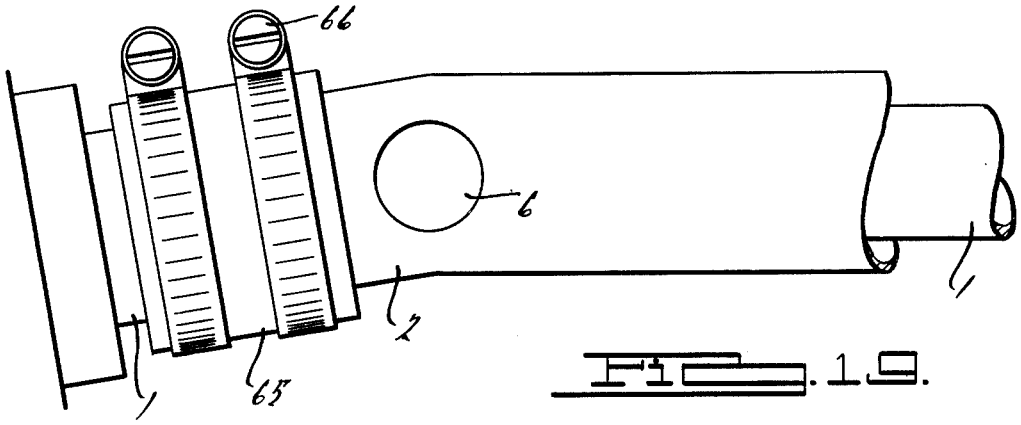
FIG. 19 is a plan view of an adapter for securing a vapor recovery spout to an existing or conventional gasoline nozzle spout.

FIG. 19 is a view of the vapor recovery nozzle spout shown in FIG. 3 being secured to the product nozzle spout 1 with a type of tight connection using a Buna-N reinforced tube 65 that is partially covering one end of the vapor recovery nozzle spout outer cylinder 2 and partially covering the entrance end of the product spout 1. The Buna-N tube 65 is tightly held in place with stainless steel hose clamps 66. This permits the securing of the vapor recovery nozzle spout to an existing nozzle spout without removing same from the nozzle. Thus, an existing nozzle and spout may be converted to a vapor recovery nozzle and spout by using the Buna-N tubing 65 and hose clamps 66.

Thus, the invention provides a vapor emission control system for the interface of the hose nozzle and a gasoline tank fill pipe 12 which may comprise a special type vapor recovery nozzle spout as illustrated in FIGS. 3 and 5 and a special type vapor seal at or in the fill pipe opening as illustrated in FIGS. 6, 7, 10, 13, 14, 19, and 20, each of which has a specific design and function but may vary in size and shape to fit the need. Various combination use of the vapor recovery nozzles and one or more vapor seals result in a tight fit to permit complete vapor recovery on all styles of gasoline fill pipe openings both on existing automobiles and new automobiles to be built and with lead or no-lead gasoline. The resulting captured vapors pass from the vapor recovery nozzle spout through a "jumper" vapor recovery hose 7 by-passing the nozzle valve and running independently and parallel and attached to the product supply hose to the gasoline dispenser 17, said vapor recovery hose preferably enters and is placed inside the product hose through a suitable adapter 37 located on the intake end of the hose nozzle and extends from the nozzle back to the gasoline dispenser.

Preferably, the vapor hose is disengaged from the product hose and attached to a vapor return line that leads to a vacuum pump or exhauster (FIGS. 15–17) that aids in the moving of the vapors from automobile gasoline tank to an underground storage tank 25 where the vapors occupy a volume space formerly occupied by the gasoline that was pumped into the automobile gasoline tank. The vacuum exhaust device of FIG. 17 is preferably located in the dispenser unit 17 on the gasoline pump island and includes a pressure flow control valve 57 and a venturi operated vapor exhauster 59, the valve being controlled by the opening and closing of the dispenser nozzle which when in the open position permits gasoline to enter and activate the venturi exhauster to create a vacuum in the vapor return line, the valve closing when the dispenser nozzle is shut off to deactivate the venturi exhauster and cut off the vacuum action. FIG. 18 shows a motor operated vacuum pump which is activated by an electrical pressure switch, the combination being located in the dispenser housing with the pressure switch attached to the discharge side of the pumping unit and the vacuum pump installed in the vapor recovery line. Additional provision is preferably made for vapors, which because of temperature differentials are in excess of the volume of the space provided, to exhaust through the underground tank vent pipe 61 on to which is attached a carbon canister 62 or other hydrocarbon deactivation so that the pipe 61 discharges clean air into the atmosphere.

As shown in FIGS. 2, 3, and 19, a vapor recovery nozzle spout may be created by slipping over the top of an existing styled nozzle spout 1 a tube 2 of larger diameter and of adequate length with a nipple 6 welded near one end of the tube for attachment of a vapor recovery hose 7, said tube being secured to the standard nozzle spout at the nipple end of the tube and at the threaded or entrance end of the product nozzle by welding or gaskets and hose clamps to make a tight, permanent vapor seal, with the opposite end of the vapor recovery tube located approximately one inch from the discharge end of the product nozzle being tapered to fit snugly around the product nozzle, said tapered end being slotted back approximately one half inch to a series of small diameter hoses that permit the vapors to enter and pass between the two concentric tubes back to the nipple 6 and then through the vapor recovery hose, said vapor recovery nozzle spout having a standard outside diameter and tapered end to provide unrestricted entrance into and through the vapor seals located in the gasoline tank fill pipes or adapters attached to same resulting in a vapor tight, friction fit seal.

As shown in FIGS. 4 and 5, a vapor recovery nozzle spout may be newly formed and created by extruding tubing 13 and shaping same to a predetermined diameter and length with a nipple 6 welded on to the outside of the tube near the end that is threaded for securing the spout to the main body of the nozzle housing, with the opposite end of the tubing being tapered as at 14 to permit unrestricted entrance and passage through the vapor seals or adapters in or on gasoline tank fill pipes, said extruded or formed tubing being provided with an internally installed vapor recovery tube 16 that is attached to an opening located near the discharge end of the nozzle spout and extends to the nipple 6 thus providing a passage for the vapors that enter the tube near the nozzle spout end to pass through the tube to the nipple then to the vapor return hose 7.

As shown in FIGS. 2, 4, and 6, the invention provides a cylindrical shaped vapor seal 18 that is designed with flexibility and resilience using a grade of Buna-N material or equivalent that can be compressed in size from its original shape to permit passage through the reduced size opening at the gasoline fill pipe entrance and once inside the fill pipe 12 expands to its original form to fit snugly against the inside diameter of the fill pipe. It may be permanently secured in place with adhesive and has an inside diameter that is slightly smaller than the outside diameter of the vapor recovery nozzle spout thus providing a friction fit and tight vapor seal when the spout is inserted and passes through the cylindrical bushing. The bushing with its desirable characteristics of resilience, compressibility and durability, is provided with a series of small high density, non-compressible Buna-N or equivalent plugs 19 that are installed in a ring around the circumference of the bushing for the purpose of centering the nozzle spout in the fill pipe and aiding in maintaining a tight friction fit and vapor seal.

As shown in FIGS. 8–10, another form of the invention is a thick walled cylindrical bushing 27 made of Buna-N material or equivalent, having a spongy texture with characteristics of compressibility, resilience, and toughness, that is mounted on and screwed with adhesive, to a metal tube 28 with inside diameter slightly larger than the outside diameter of the vapor recovery nozzle spout 2 to permit a slip fit over same. The length of the metal tube 28 is greater than the length of the Buna-N cylindrical bushing to permit the welding of two lugs 29 of size and shape to permit them to fit into the two notches located on the face of the entrance to the gasoline fill pipe. The combination of thick walled cylindrical bushing, metal tube, and welded on lugs provides a vapor seal adapter than can be slipped on to the vapor recovery nozzle spout and secured against the stop ring on the nozzle spout with adhesive for a permanent fit or a section of rubber tubing for a temporary fit, said combination of spout and seal when inserted into the fill pipe forms a tight vapor seal when the two lugs are placed in the notches in the fill pipe and the nozzle is twisted thus compressing the thick walled bushing against the face of the fill pipe creating a tight vapor seal.

As shown in FIGS. 13, 20, and 21, a form of the invention is an adapter extension for the gasoline fill pipe has a permanently installed cylindrical vapor seal bushing 18 mounted inside of a metal cylinder 30 whose diameter is approximately the same or the diameter of the fill pipe 12, with returns on both ends of the cylinder that have an opening diameter slightly larger than that of the vapor recovery nozzle spout so that it passes through and gives support to same. On one end of said cylinder is a ring or short tube on which are provided two ugs 32 that fit into the two notches on the fill pipe opening, with a ring gasket 33 mounted over the small tube and engaging the face of the metal cylinder. The adapter extension, when mounted on the face of the fill pipe, permits the positioning of a vapor recovery nozzle spout into and through the bushing seal when fueling the vehicle, said adapter extension being removed from the fill pipe when the fueling operation is completed.

As shown in FIG. 14, in another form the invention comprises a cylindrical shaped vapor seal having flexibility, resilience, and durability made of a Buna-N material or equivalent that is permanently mounted in the fill pipe 12 of a newly built vehicle, the fill pipe being designed with a configuration so as to support the vapor recovery nozzle spout at the fill pipe entrance and also support the spout at a point inward from the entrance by providing a depression ring 41 built into the circumference of the fill pipe. The cylindrical vapor seal 18 which has an inside diameter slightly smaller than the outside diameter of the vapor recovery nozzle spout, is placed in the fill pipe and located between the entrance opening of the fill pipe and the depression ring. It is a cylindrical vapor tight Buna-N bushing and may be provided with Buna-N non-compressible plugs to position the nozzle spout if newly built vehicle is not equipped with a depression ring 41 built into fill pipe.

Another approach is shown in FIG. 7 in which a ring shaped magnet 21 is secured to an expandable sleeve 20 that is slipped over and mounted on a vapor recovery nozzle spout 13 and secured to same with a tight fit connection on the discharge side of the vapor recovery nipple that is welded to the spout. The combination of magnetic ring and expandable sleeve forms a tight vapor seal with the fill pipe 12 when the vapor return nozzle spout is inserted in the gasoline fill pipe and the ring magnet comes in contact with the face of the fill pipe and adheres to same. The magnetic ring and expandable sleeve can be equipped with an anchor spring to hold nozzle in place for automatic filling or used in combination with a vapor seal bushing (FIGS. 6 and 14) permanently installed in the fill pipe, or with a vapor seal adapter extender (FIGS. 10, 20, and 21) mounted on the fill pipe prior to inserting the nozzle spout.

I claim:

1. In a gasoline vapor emission control system for use with a motor vehicle having a gasoline tank with a fill tube having an opening, a gasoline dispenser, a gasoline dispensing nozzle having a spout to enter said fill tube, a gasoline vapor passage tube means of fixed length and of smaller cross sectional area than said spout mounted on the spout and extending over a major part of the length thereof and having an inlet opening located inside the fill tube and an outlet opening located outside the fill tube and adjacent a vapor receiving receptacle when the spout is inserted in the fill tube, a gasoline delivery hose connecting said nozzle to said dispenser, and vacuum type vapor flow assist means connected to said tube means.

2. The invention as set forth in claim 1 wherein said tube means comprises a tube on the outside of and surrounding the spout.

3. The invention as set forth in claim 1 wherein said tube means comprises a tube inside of the spout.

4. The invention as set forth in claim 1 including a rubber-like bushing in the filler tube providing a seal for the filter tube to force all gasoline vapor to flow through the tube means.

5. The invention as set forth in claim 1 including a vapor passage conduit connected to the outlet opening of said tube means.

6. The invention as set forth in claim 5 wherein said vapor passage conduit is located inside of said hose.

7. The invention as set forth in claim 1 including a safety wall responsive to pressure inside said gasoline vapor passage and operative to venting said passage under preselected conditions.

8. The invention as set forth in claim 1 including a gasoline storage tank, said gasoline dispenser being connected to the tank to receive gasoline therefrom, a vapor passage conduit connecting said tube means to said dispenser, a vapor return conduit connecting said dispenser to said storage tank whereby said tank provides said vapor receiving receptacle, said vapor passage conduit being connected to said vapor return conduit, said vacuum assist means comprising vacuum generating means in said dispenser connected to one of said conduits to furnish vacuum to said tube means to assist flow of vapors, and means actuated by flow of gasoline from the tank to the nozzle for operating said vacuum generating means.

9. The invention as set forth in claim 8 including a vacuum regulator valve means connected to one of said conduits for preventing excessive vacuum in the tube means.

10. The invention as set forth in claim 8 including a vent pipe line for the storage tank and having an outlet opening to atmosphere, said vent pipe line including means to remove undesired emissions from the gas flowing through the line prior to its reaching said outlet.

11. The invention as set forth in claim 1 including an imperforate flexible sealing sleeve on the outside of said spout outside of said filler tube, and an annular magnet attached to the sleeve and seatable on the filler tube to provide a sealed space inside the filler tube when the spout is inserted therein.

12. The invention as set forth in claim 2 including a rubber-like bushing sealing the end of said tube outside of the filler tube to the spout, and hose clamps around said bushing and clamping it to the tube and spout.

13. In a gasoline vapor emission control system for use to collect gasoline vapors emitted during filling of a motor vehicle gasoline tank, said tank having a fill tube with an entrance opening, a gasoline dispensing nozzle having a spout to project into said fill tube through said entrance opening, means for sealing the spout and fill tube to substantially restrict escape of vapor to atmosphere adjacent said fill tube, a gasoline storage tank, a gasoline dispenser connected to the gasoline storage tank to receive gasoline from it, a hose connecting the dispenser to the nozzle to deliver gasoline to the nozzle, means providing a gasoline vapor return passage having an inlet end extending into the inside of the vehicle gasoline tank when the spout is inserted into the fill tube, said means being supported by said nozzle, said vapor return passage extending to and having an outlet into said gasoline storage tank whereby gasoline vapors in said vehicle tank have a flow passage to the gasoline storage tank, and fluid pressure generating and control means in said vapor return passage to assist flow of said vapors through said passage from the gasoline tank to the storage tank.

14. The invention as set forth in claim 2 including a longitudinally compressible seal member mounted on the outside of said vapor passage tube means and engageable with the end of the fill tube to form a seal for the fill tube.

15. A system as set forth in claim 3 wherein said means providing a gasoline vapor return passage comprises a hose inside of the hose connecting the dispenser to the nozzle.

16. A system as set forth in claim 3 wherein said fluid pressure generating and control means includes means responsive to flow of gasoline from the tank to the nozzle for generating a vacuum to assist flow of said vapors.

17. A system as set forth in claim 6 wherein said means responsive to flow of gasoline comprises a vacuum exhauster in said vapor return passage and receiving by-pass flow of gasoline flowing to the nozzle.

18. A system as set forth in claim 3 wherein said fluid pressure generating and control means comprises a vacuum pump operated when gasoline flows to said nozzle.

* * * * *

UNITED STATES PATENT AND TRADEMARK OFFICE

CERTIFICATE OF CORRECTION

PATENT NO. : 4,166,485

DATED : September 4, 1979

INVENTOR(S) : Albert L. Wokas

It is certified that error appears in the above-identified patent and that said Letters Patent are hereby corrected as shown below:

| | |
|---|---|
| Col. 3, line 22 | "16" should be --6-- |
| Col. 3, line 45 | "axis" should be --axial-- |
| Col. 3, line 62 | "mades" should be --makes-- |
| Col. 3, line 64 | "culindrical" should be --cylindrical-- |
| Col. 4, line 12 | "made" should be --make-- |
| Col. 6, line 3 | "are tough" should be --tough and durable-- |
| Col. 10, line 43 | "screwed" should be --secured-- |
| Col. 11, line 5 | "ugs" should be --lugs-- |
| Col.12, line 3 (Cl. 4) | "filter" should be --filler-- |
| Col. 13, line 6 (Cl. 15) | "3" should be --13-- |
| Col. 13, line 10 (Cl. 16) | "3" should be --13-- |
| Col. 14, line 3 (Cl. 17) | "6" should be --16-- |
| Col. 14, line 7 (Cl. 18) | "3" should be --13-- |

Signed and Sealed this

Seventh Day of July 1981

[SEAL]

Attest:

RENE D. TEGTMEYER

Attesting Officer

Acting Commissioner of Patents and Trademarks